US008632207B2

(12) United States Patent
Bowen

(10) Patent No.: US 8,632,207 B2
(45) Date of Patent: Jan. 21, 2014

(54) LED LIGHTING APPARATUS AND HOUSING

(75) Inventor: Donald Bowen, Acton, MA (US)

(73) Assignee: Lex Products Corporation, Shelton, CT (US)

( * ) Notice: Subject to any disclaimer, the term of this patent is extended or adjusted under 35 U.S.C. 154(b) by 77 days.

(21) Appl. No.: 12/940,819

(22) Filed: Nov. 5, 2010

(65) Prior Publication Data

US 2012/0113633 A1 May 10, 2012

(51) Int. Cl.
*F21V 21/00* (2006.01)

(52) U.S. Cl.
USPC ..... 362/217.16; 362/222; 362/311.02

(58) Field of Classification Search
USPC ..... 362/218, 219, 221–217.02, 362/217.1–217.17, 235, 240, 362/249.01–249.02, 264, 311.01–311.02
See application file for complete search history.

(56) References Cited

U.S. PATENT DOCUMENTS

| | | | | |
|---|---|---|---|---|
| 5,151,679 | A * | 9/1992 | Dimmick | 340/326 |
| 5,782,552 | A * | 7/1998 | Green et al. | 362/183 |
| 6,860,628 | B2 * | 3/2005 | Robertson et al. | 362/555 |
| 6,874,911 | B2 * | 4/2005 | Yoneda | 362/294 |
| 6,946,856 | B1 * | 9/2005 | Tellkamp | 324/754.1 |
| 6,953,262 | B2 * | 10/2005 | Cleaver et al. | 362/219 |
| 7,186,005 | B2 * | 3/2007 | Hulse | 362/255 |
| 7,224,000 | B2 * | 5/2007 | Aanegola et al. | 257/98 |
| 2003/0179584 | A1 * | 9/2003 | Pond et al. | 362/487 |
| 2005/0276053 | A1 * | 12/2005 | Nortrup et al. | 362/294 |
| 2007/0064409 | A1 * | 3/2007 | Hulse | 362/84 |
| 2007/0109788 | A1 * | 5/2007 | Pan | 362/294 |
| 2008/0144315 | A1 * | 6/2008 | Chen et al. | 362/294 |
| 2011/0176297 | A1 * | 7/2011 | Hsia et al. | 362/217.1 |

* cited by examiner

*Primary Examiner* — Julie Shallenberger
(74) *Attorney, Agent, or Firm* — Steven McHugh

(57) ABSTRACT

A lighting apparatus and method for making the same are presented. In some aspects the apparatus includes a plurality of LED light sources mounted to a metal circuit board in a housing of the apparatus. In other aspects a light-permissive potting compound is disposed in the space between the LEDs and circuit board and the housing of said apparatus so as to permit exit of light from said LEDs while providing mechanical protection for the circuit board and LEDs and removing heat generated from said LEDs.

13 Claims, 8 Drawing Sheets

LED LIGHTING APPARATUS AND HOUSING

TECHNICAL FIELD

The present application generally relates to lighting products and methods for making the same, and particularly as applies to the design of portable lighting devices employing light-emitting diode (LED) light sources.

BACKGROUND

Portable lighting sources are useful in many contexts, including to illuminate spaces that lack an operational fixed lighting fixture therein as well as for lighting places that normally do not have a source of light therein or nearby.

Some lighting fixtures are equipped with long extension cords to provide power to the same from a power outlet some distance away from the place in which the light is needed. Other lighting fixtures are powered by internal direct current (DC) power sources such as batteries. These lights are generally portable and most often rely on fluorescent or incandescent or light emitting diode (LED) light sources.

Each of these light sources generates heat when it is powered and emitting light, in fact some light sources such as incandescent lights rely on the heating effect of current in the light filament as a requisite to generating any light at all. Therefore, incandescent lights are by definition not very energy efficient as they dissipate a substantial fraction of their energy as non-visible heat radiation. Fluorescent lights generate less heat than incandescent lights but suffer from large physical size bulbs, require electrical ballast components operating at high voltages, emitting substantial electromagnetic noise as a result. In addition, incandescent and fluorescent light bulbs are not very mechanically resistant to shocks so they break relatively easily if dropped or used in hostile environments.

LED lights employ small solid state diodes that can be made more robust to mechanical shock and take up far less space that the other types of light sources. However, until recently LED lights have provided very little illumination intensity and were not practical for use as light sources to light up a work space. So far there have been no practical applications of LED lighting that could effectively provide bright lighting intensities while controlling the heating or overheating of the LED diodes, which can be damaged if temperatures above 90 degrees Celsius develop in the lighting fixture. Providing stable electrical to the LED circuitry was also not well developed. Other challenges such as mechanical stabilization of the lighting sources have also remained open in the prior art.

The present disclosure solves several problems of the known art, especially in the context of LED light sources for multi-LED lighting apparatus that is suitable for use in harsh environments and is cost effective to use and manufacture.

SUMMARY

The present disclosure provides a lighting apparatus and method for making and assembling the same, which include one or more LED light sources and various mechanical and electrical components for the same.

The present lighting apparatus includes a tough yet versatile housing to contain and protect the light sources and to improve the functional characteristics of the apparatus. Specifically, the present systems and methods provide improved light distribution, improved usability, greater efficiency, reduced electromagnetic interference (EMI) characteristics, enhanced heat distribution abilities, increased reliability, and other features.

Some preferred embodiments are directed to a portable lighting apparatus, comprising a solid housing, a circuit board having a metallic substrate disposed within said housing and providing mechanical and electrical support for a plurality of LED light sources, a plurality of LED light sources being electrically and mechanically coupled to said circuit board, an optically-permissive compound capable of transmitting at least a substantial portion of light output of said LED light sources, the compound substantially filling a space between an interior surface of said solid housing and said circuit board and LED light sources so as to provide mechanical contact with at least a portion of said circuit board and said LED light sources and said housing, and a power supply circuit for providing electrical power from a power source to a portion of said circuit board so as to energize said LED light sources.

BRIEF DESCRIPTION OF THE DRAWINGS

For a fuller understanding of the nature and advantages of the present invention, reference is be made to the following detailed description of preferred embodiments and in connection with the accompanying drawings, in which.

DETAILED DESCRIPTION

Figure 1:
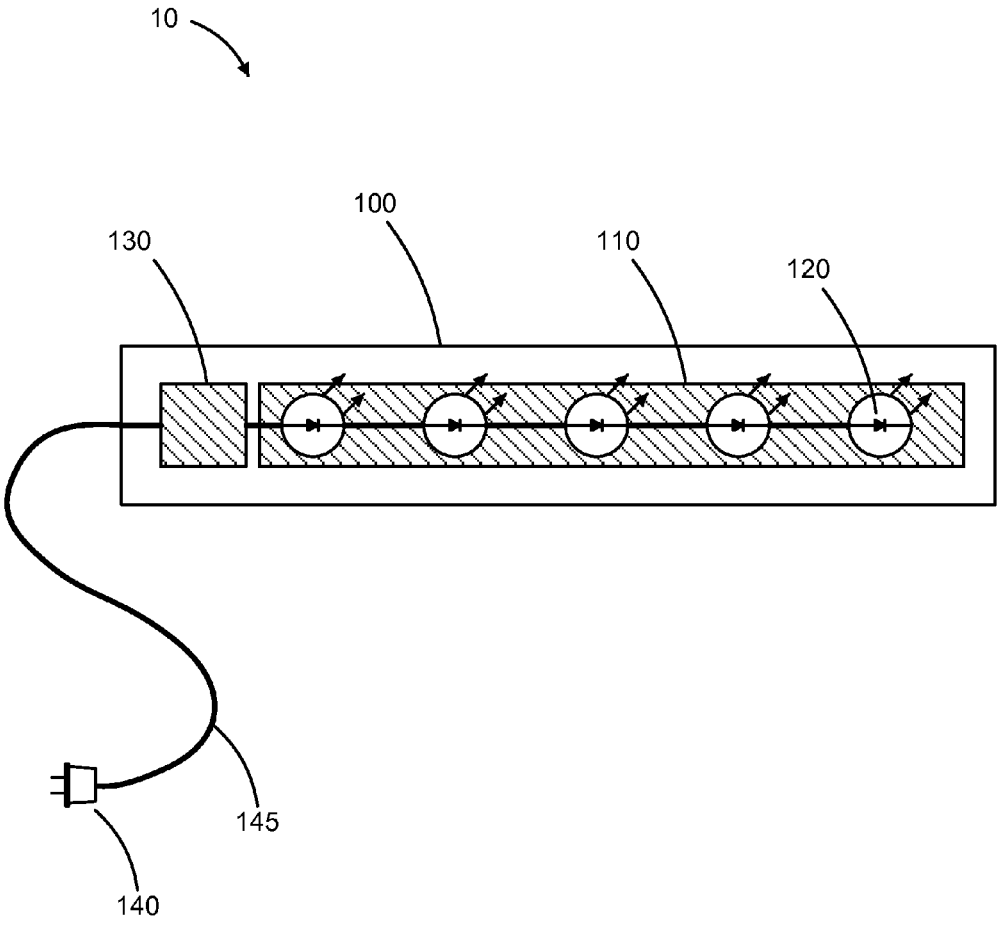
FIG. 1 illustrates an exemplary embodiment of a lighting apparatus and major components thereof.

FIG. 1 illustrates an exemplary embodiment of an AC-powered lighting apparatus 10 comprising a housing 100. Within the housing are disposed a plurality of LED light sources 120 disposed on a circuit board 110 or similar mechanical-electrical support platform or substrate that can accommodate providing mechanical securement to LEDs 120 and also enable connection of electrical power to LEDs 120.

AC power is provided through an AC outlet plug 140 coupled to a length of conducting cable or insulated conductor 145. Note that insulated conductor 145 is simplified in the drawing, but actually may contain two or more electrical conducting lines inside an insulated jacket, and in some embodiments may include three or more lines to provide a plurality of current paths to power the apparatus, a ground line, or other electrical conduction paths. An electrical power pack 130 is disposed in a way that takes the AC power from a source of said AC power and converts it to a form usable to power the LEDs 120. In some embodiments, as will be discussed in further detail below, the electrical power pack 130 includes one or more of: an AC-to-DC converter, a transformer, a rectifier circuit, a voltage reference circuit, a current reference circuit, conditioning circuits, filters, inverters, amplifiers, or other components as appropriate. Note that the electrical power pack 130 may be disposed in the housing 100 as shown, but in some embodiments it may reside outside housing 100, e.g., inline with power cord 145 as in a "power brick" configuration. FIG. 1 is meant as a mere illustration of some major components of various embodiments, some of which will be discussed in more detail below.

Figure 2:
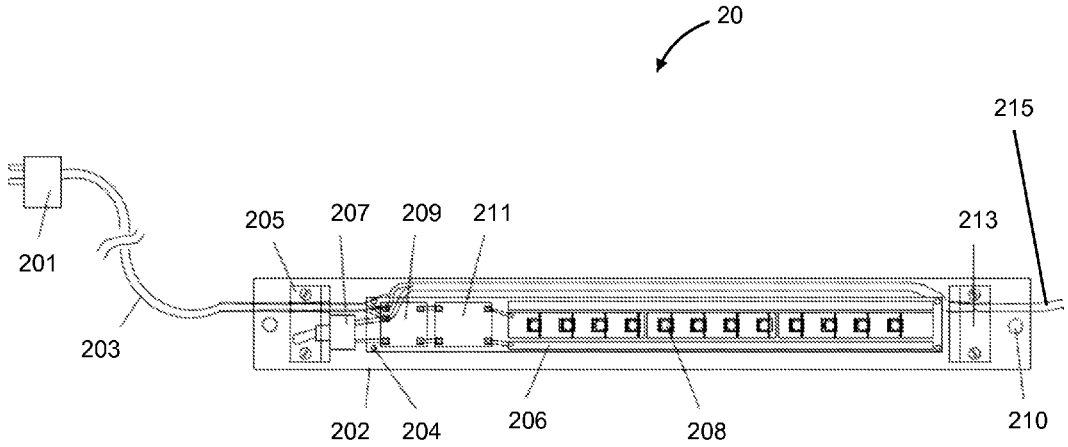
FIG. 2 illustrates an exemplary lighting apparatus with electrical power and housing components according to some embodiments.

FIG. 2 illustrates an exemplary embodiment of a lighting fixture apparatus 20. The apparatus comprises a power source, which can come from an AC electrical outlet connected to an AC power plug 201 or adapter to couple AC power to apparatus 20. Power plug 201 may be of a variety of constructions, usually having two or more conducting male prongs extending from an insulated body. The male prongs can be inserted into corresponding female adapters or outlets as known to those skilled in the art. The plug 201 may be made to fit conventional 120 VAC or 220 VAC or other AC or DC power source sockets. The plug 201 however can be made to suit almost any situation, and is not limited to male-formatted plug types.

A conductor cable 203, which may itself comprise a plurality of conducting lines coupled to the prongs of power plug 201, carries electrical power between plug 201 and the rest of the apparatus. The electrical power circuitry of the apparatus powers one or more light sources (e.g., LEDs 208) to provide light to the environment of the apparatus. The conductor cable 203 may be flexible and as long as is reasonable or convenient. The cable 203 may be for example 3 or more feet long, or in some cases 10 or more feet long, or even 100 or more feet long, thereby serving as its own extension cord in cases where the light is needed some distance away from a power supply socket.

Apparatus 20 may comprise a solid body, case, or housing 202, which may be made of a hard plastic and may be a unibody construction or made of more than one part mechanically connected together. In some embodiments, housing 202 includes at least a portion thereof made of a transparent or translucent or light-permeable material that allows light from one or more LED light sources in the apparatus to propagate outside the apparatus and illuminate a space around the apparatus. The housing 202 may be elongated in shape so as to suit various applications, but is not so limited. For example, the housing 202 may be generally cylindrical in shape having a long axis that runs down the length of the apparatus and having a generally circular or semi-circular cross-section. The apparatus may be easily gripped by a user in the user's hand in some embodiments. In other embodiments the apparatus may be hung from a hanger or a hook for convenience. In yet other embodiments the apparatus includes fasteners that allow clipping, attachment, or fastening the apparatus to corresponding or mating surfaces or fasteners or holders. In some embodiments, a hole 210 is provided for attaching a hook or fastening apparatus as described above to the housing 202 of apparatus 20, but this is only an exemplary arrangement and many other suitable arrangements are of course also possible as desired for a given application.

The apparatus 20 may be coupled to other electrical devices. For example, in some scenarios, another similar apparatus 20 may be coupled to a power line 215 so that the devices are connected to one another in series with one device providing power to the next downstream from it. In some arrangements this provides for a "daisy chain" configuration of lighting devices that are serially powered from an original AC or DC power source.

Power supply to the apparatus is provided through plug 201 and power cord 203 to a multi-function electrical unit 205 comprises electrical and electro-mechanical components, as useful in a particular application, to provide a switched useful electrical supply of power other units in apparatus 20. Note that the arrangement and ordering of the circuit components described herein is exemplary. Other arrangements, groupings and ordering of the components may be employed as best suited for a particular application.

Multi-function end units 205 and 213 may be used in some embodiments to simplify construction of apparatus 20. The end units 205, 213 provide closure to either end of elongated body or housing 202 of apparatus 20. In addition, end units 205, 213 may serve as strain relief for power cord 203, water or airtight seals, heat sinks, and mechanical isolation for sensitive components within housing 202. Specifically, a plurality of mechanically isolating or shock absorbing spacers 204 may be coupled to end units 205, 213 so as to reduce the effects of a mechanical shock to the components of the apparatus, such as the effects of dropping the apparatus. The spacers 204 also serve to properly place the other elements within the body of the apparatus.

Switch 207 may be a conventional ON/OFF switch (e.g., toggle, rocker, knife, slide, barrel, push, or other switch type). Switch 207 may provide simple on and off functionality by making or breaking a series circuit connection. However, switch 207 may have more than one pole or position, and may additionally place the device into a high or low power mode, variable brightness modes, switch between one or more banks of light sources (LEDs), switch between one color and another and so on. In some embodiments the latter functions are enabled by moving switch 207 into one of a plurality of selectable positions so as to control one or more of corresponding circuit configurations powering selectable ones of a plurality of subsets of LED sources in the apparatus. A circuit breaker, current or voltage limiter, or fuse to protect sensitive components from over-current or over-voltage conditions may also be included in the power supply components of the apparatus.

A power conditioning component 209 may be employed to convert an AC power supply to a DC power output for powering the components downstream of the power conditioner 209. The power conditioner 209 may also step one DC voltage up or down to another DC voltage as appropriate. Additionally, the power conditioner 209 may be used to filter the electrical power, correct its power factor by altering the real and imaginary power components, amplitudes, phases, or other aspects of the electrical power signals within the apparatus.

A voltage regulator 211, or a current regulator, may be included in the power circuit for apparatus 20 as well. The regulator 211 may be useful to regulate the power level, voltage, or current to LEDs 208 in order to apply a constant electrical signal thereto and thereby to yield a constant light intensity output from the LEDs and reduce oscillatory or flickering light output effects when fluctuations occur on the power line supplying apparatus 20. In some embodiments one or more LED light sources are powered by 3.5 Volts DC, but this is merely an example of the types of LED light sources that can be used herewith, and those skilled in the art may understand other suitable operating voltages for powering the present apparatus.

As mentioned elsewhere, various present embodiments have the LED light sources 208 coupled to and powered by a metal circuit board 206. The metal circuit board 206 can provide electrical power to the plurality of LED lights 208 and other components of apparatus 20, and can further provide power to downstream lighting fixtures through conductors 215 if so equipped. In addition, metal circuit board 206 provides solid mechanical mounting for the LED lights 208. Furthermore, metal circuit board 206 provides for heat sink (removal of heat) functionality to limit the temperature rise in LEDs 208.

The metal circuit board 206 is optionally embedded in or thermally coupled to an electrically insulating but optically permissive medium called a potting compound. The potting compound can be made to fill the interior space defined by the shell of housing 202, and may fill substantially any air gaps proximal to LEDs 208 and/or metal circuit board 206. In some instances, air is evacuated from the interior of apparatus 20 during construction substantially simultaneously with filling the interior of said apparatus with said potting compound. In a specific example, potting compound material is injected into or extruded into a first end of the elongated body of housing 202 while air is pulled out from a second opposing end of housing 202 so as to suck a liquid or semi-liquid or gel potting compound material into said first end.

Figure 3:
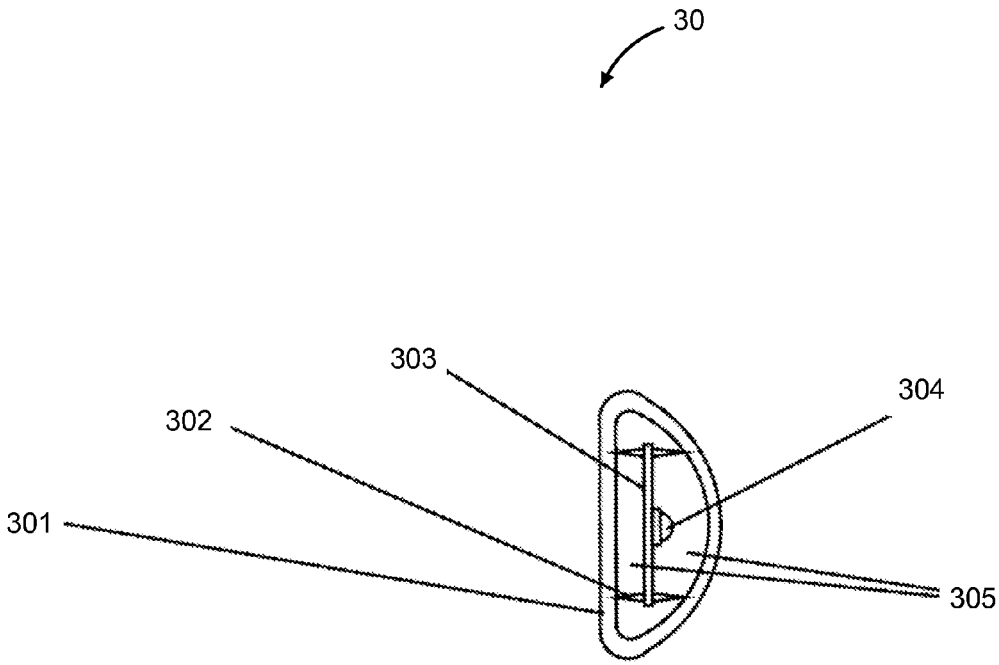
FIG. 3 illustrates an exemplary cross section of a lighting apparatus according to some embodiments.

FIG. 3 illustrates an exemplary cross-section of a LED lighting apparatus 30, which may be similar to the apparatus depicted and described above. The apparatus in the depicted embodiment has a substantially D-shaped cross sectional shape. This can allow for convenient gripping of the apparatus in some aspects, and in other aspects can provide a stable shape that prevents rolling of the apparatus off of a table or other flat surface so that the lighting apparatus 30 may be placed on its flat side and remain stably put.

A housing 301 contains, protects and houses various components of the apparatus 30. A metal or similar circuit board 303 is disposed within a cavity defined by housing 301. The circuit board 303 may be substantially centered within the cavity by a set of spacers 302 that can provide electrical and/or mechanical isolation of the circuit board 303. A plurality of LED light sources 304 are coupled to or attached to the circuit board 303 and are also disposed within a space defined by housing 301. In some embodiments a potting compound is used to fill one or both sides of circuit board 303. For example, the potting compound can be injected into the interior volume of housing 301 around the LEDs 304 and circuit board 303 in spaces 305.

In some aspects, a rigid and thermally-conducting (e.g., metallic, metalized or metal) circuit board, which may have non-electrically-conducting layers as well as will be explained below, is used. The circuit board may be made to substantially be suspended or floating in the potting compound surrounding the board. The compound is sufficiently viscous or rigid to maintain the circuit board suspended or floating therein when placed in the housing of the apparatus surrounding the circuit board. Flexible centering tabs may be used to center (or substantially place) the circuit board within a cavity defined by the shell of the housing of the apparatus. The potting compound can then be flowed into the empty spaces inside the housing around the circuit board and the circuit board would remain substantially in place after the potting compound cures.

The potting compound, as discussed elsewhere herein, may be of a silicone gel type that is substantially optically clear or permissive. The potting compound can be injected or vacuum drawn or pressure-driven into cavities 305 as described above. In some aspects the potting compound may solidify somewhat to provide a rubbery consistency that mechanically supports the LEDs 304 and protects them from damage or shock. In other aspects the potting compound provides positive internal pressure that prevents the shell of the apparatus housing 301 from being broken or compacted from an external blow or external pressure. In yet other aspects the potting compound is relatively thermally conducting or absorbing, and therefore, the potting compound provides a better mechanism for removing heat from LEDs 304. The LEDs are thereby cooled by the potting compound through conduction of heat generated in the LEDs. The heat removed from the LEDs 304 may be conducted by the potting compound to the surroundings of lighting apparatus 30. The conduction of heat away from the hot elements (e.g., the LEDs 304) in the apparatus may be enhanced by the insertion of thermally conductive metal cooling fins embedded into certain portions of the potting compound. Convection or other means of conduction are allowed to cool the apparatus 30 as a whole or to cool the apparatus through a heat exchange element coupled to or built into the apparatus.

In some embodiments optical materials can be included in the potting compound so as to cause a favorable optical behavior of the compound. For example, in order to make the light from LEDs 304 more diffuse, a translucent potting compound may be used instead of a strictly clear compound. Other optical properties of the potting compound may be designed, for example to favorably filter in or filter out certain light frequency ranges by using absorbing or permissive or polarized substances infused into the potting compound material. Alternatively, or in addition, light scattering elements can be disposed in the potting compound. For example, small scattering beads of given geometry, size and density can be mixed into the potting compound when it is prepared for use so that the final product presents the light from LEDs 304 with a scattering medium about LEDs 304 that causes scattering of the emitted light into the general environment of apparatus 30. Small air bubbles, small droplets of other fluids, small reflective glass or metal or other crystalline shavings or recycled crushed substances or nano-particles may all be used to achieve desired optical and other properties of the potting compound matrix injected into spaces 305 in lighting apparatus 30.

Figures 4, 4A, 4B, 4C:
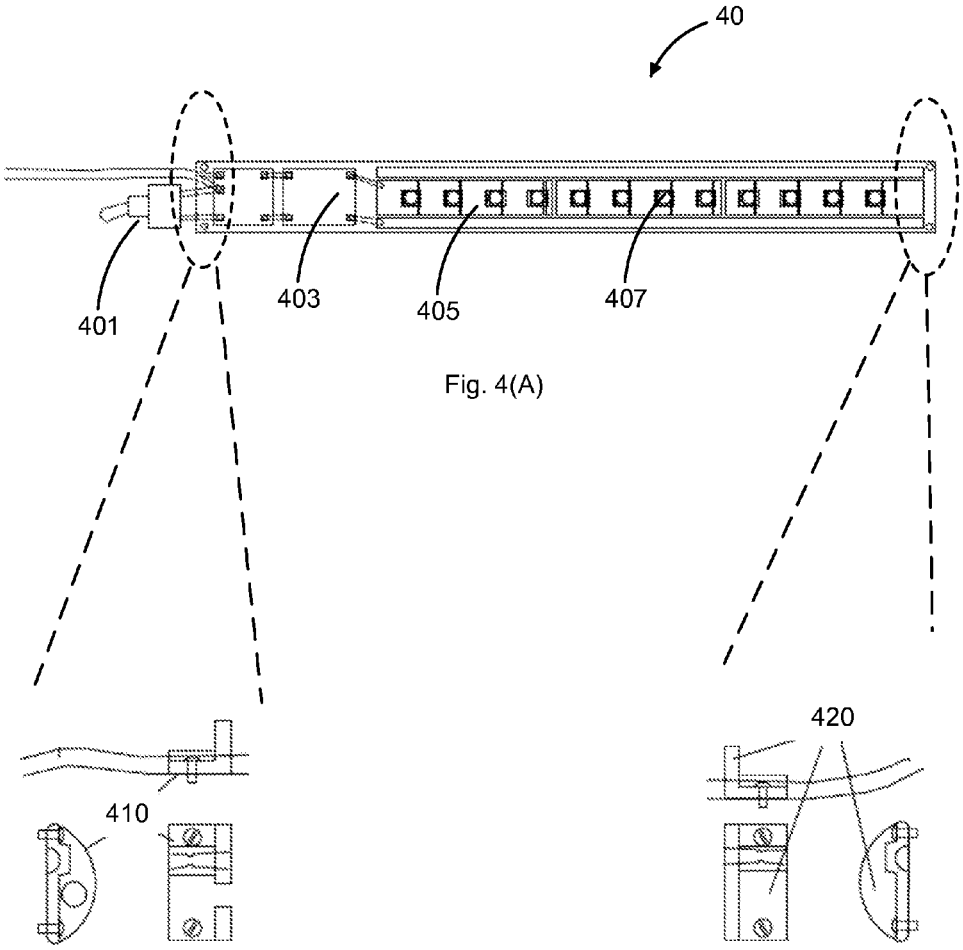
FIG. 4 illustrates end cap units of an exemplary lighting apparatus according to some embodiments.

FIG. 4 illustrates yet another exemplary embodiment of a LED lighting fixture 40 according to the present disclosure. FIG. 4(A) shows an exemplary arrangement of components similar to those described above, where the apparatus includes a plurality of LED light sources 407 mounted on a metal or metallic circuit board 405 and powered by a power conditioning circuit element 403 and switched by a power switch 401.

The end caps 410 and 420 of the apparatus 40 are illustrated in FIG. 4(B) and FIG. 4(C), which show the apparatus in cross section near the end cap locations at either end of the apparatus. As discussed earlier, the circuit board 405 and other components may be fixed in place by isolating spacers disposed between the circuit board and the housing of the apparatus.

Figure 5:
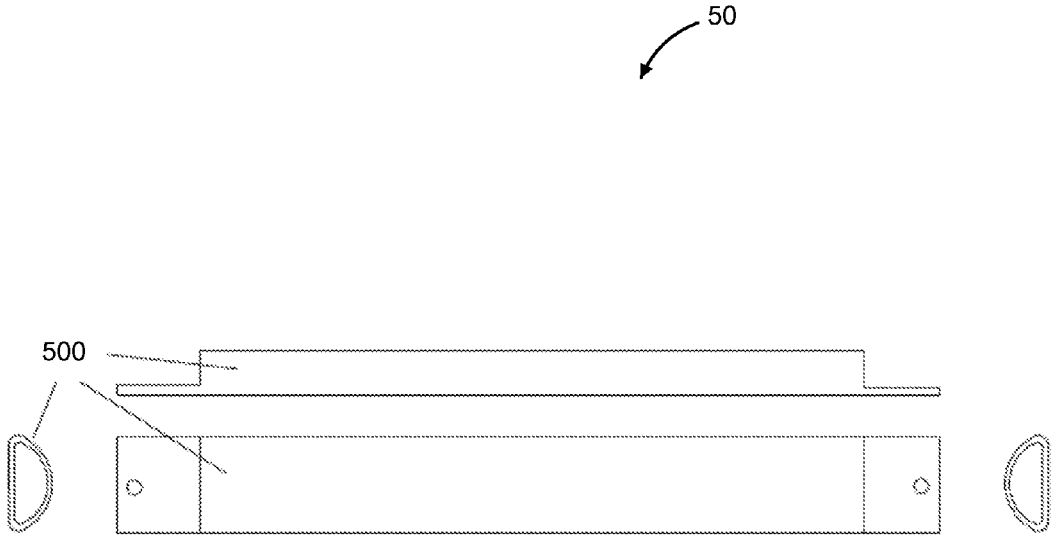
FIG. 5 illustrates another view of some mechanical components of a lighting apparatus according to some embodiments.

FIG. 5 illustrates a simplified mechanical arrangement of a lighting apparatus 50 and shows a variety of exemplary views 500 of the apparatus. The apparatus has a substantially D-shaped profile or cross-section, but it is to be appreciated that circular, oval, elliptical, rectangular and other cross-sectional designs are possible as well.

The end caps mentioned above can serve several functions: first, they can be used to mechanically seal the ends of the tubular housing to protect the internal components from contamination and moisture; second, the end caps can be used to pinch or mechanically secure the electrical power connections and cords running in and out of the apparatus and provide stress relief to the cords; third, the end caps being of a solid material (e.g., a metal or a solid polymer) can be used as mounting points for power switches and other components. Other uses of the multi-functional end caps are also possible.

Figure 6:
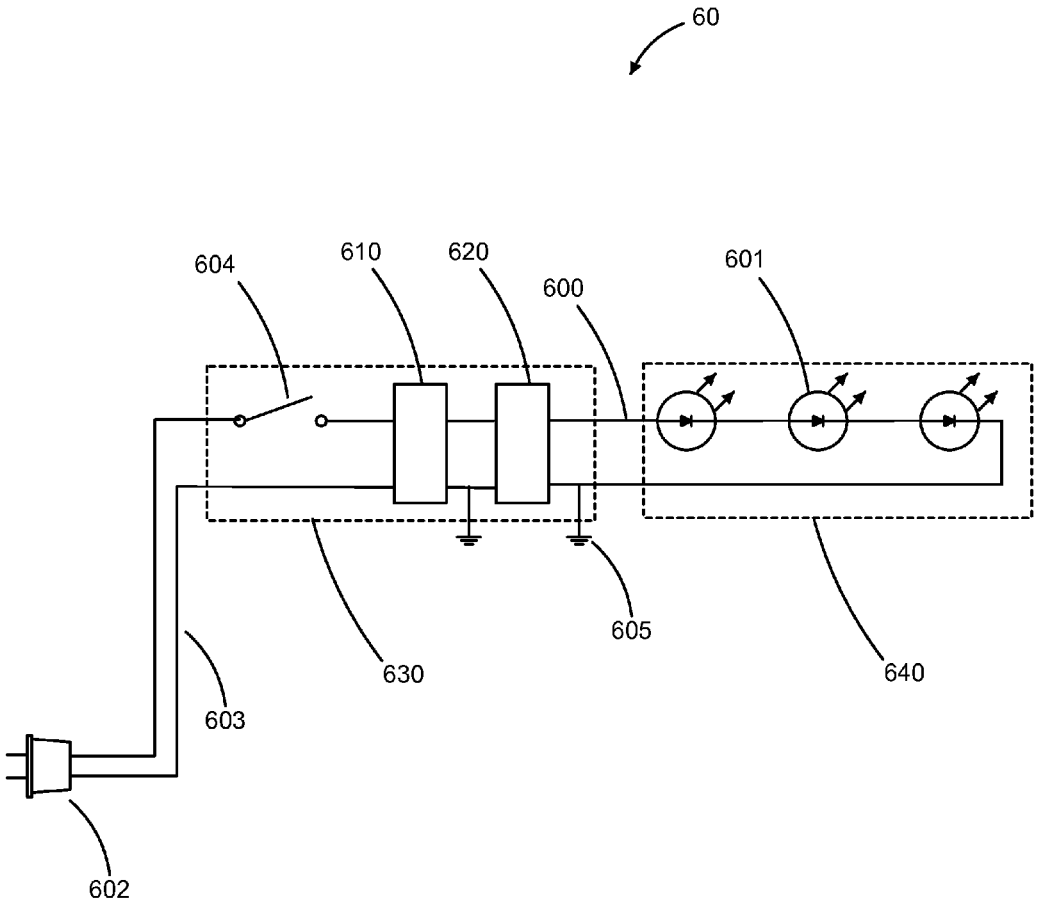
FIG. 6 illustrates an exemplary arrangement for powering a single group of LED sources in a lighting apparatus.

FIG. 6 illustrates an exemplary LED lighting apparatus 60 according to some embodiments. The apparatus is powered from an AC power plug 602 that can be plugged into a conventional AC wall outlet, e.g. 120 VAC or 220 VAC outlet. A two-conductor cord 603, which is protected by an insulating jacket (not shown) carries AC current to the apparatus. A three-conductor cord may include a ground wire in some embodiments. A power unit 603 is shown by a dashed rectangle and represents the various electrical power components described earlier, which can be arranged in one or more physical groupings co-located or not co-located, as best suits an implementation at hand. A power switch 604 interrupts the circuit powering the apparatus so as to control the power to LED light sources 601. A transformer, rectifier, filter, and other components may be provided in circuit elements 610 and 620, which can comprise a power conditioning circuit and a voltage or current regulator, respectively. The circuits may be grounded with ground connection 605. As can be seen, all of the LEDs 601 in the lighting unit are powered in series with one another.

Power from the power unit 603 is provided to lighting unit 640. Lighting unit 640 may include the LEDs 601 as well as the circuit board on which the LEDs are mounted. All of the components of the apparatus 60 may be housed together in a solid housing as described earlier. In some embodiments some of the power supply components can be disposed in a power unit that is physically manufactured separately from the lighting unit.

Figure 7:
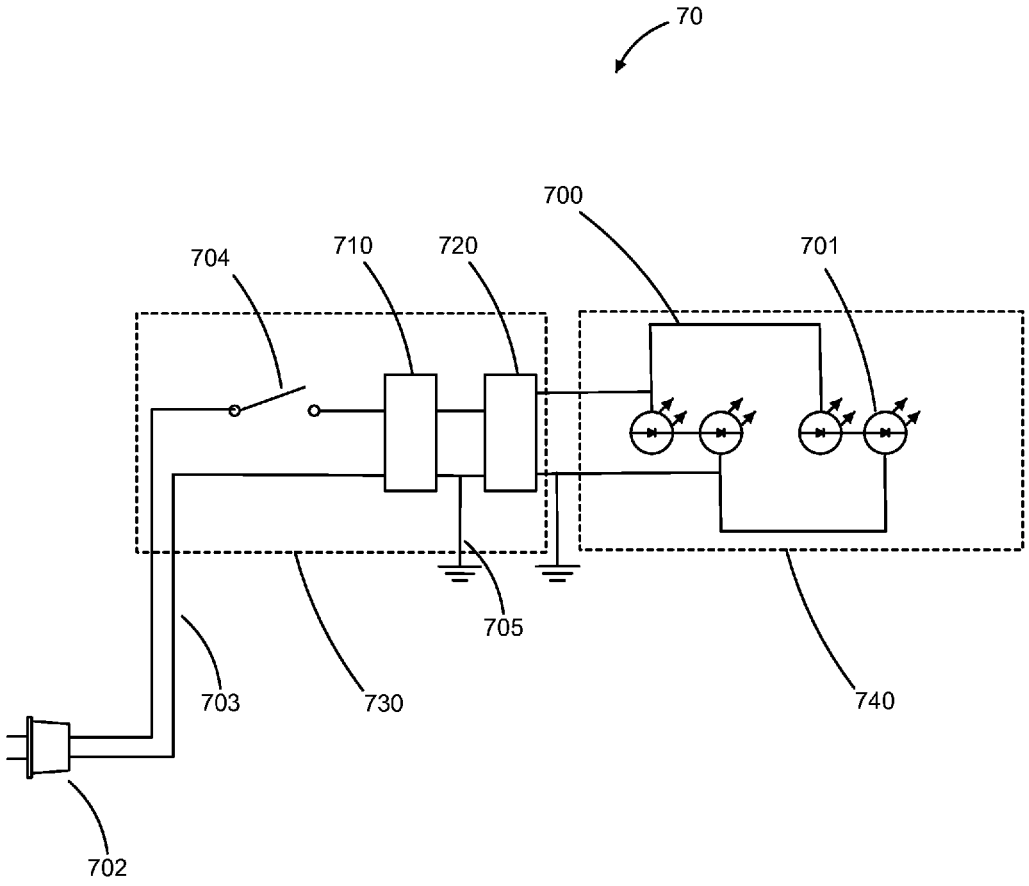
FIG. 7 illustrates an exemplary arrangement for powering more than one group of LED sources in a lighting apparatus.

FIG. 7 illustrates another exemplary embodiment of a LED lighting apparatus 70. The apparatus comprises an electrical power unit 730 powered by a power plug 702 through a power cord of conductors 703 as discussed before. The system may be grounded by one or more ground connections 705. Again, the power components may reside in a same housing as the lighting unit 740 or may be placed in a separate power brick connected to the lighting unit 740.

Switch 704, power conditioner 710 and regulator 720 operate similar to that described before. However, the circuit 700 feeding the individual banks of LEDs 701 is arranged so as to power a plurality of groups of LED lights 701 in discrete subsets as shown. That is, instead of arranging all of the LEDs 601 as in the previous drawing, the LEDs 701 are arranged in distinct groupings, the groups being powered in parallel but the groups themselves allowing for a plurality of LEDs to be powered in series with one another in the same group.

Figure 8:
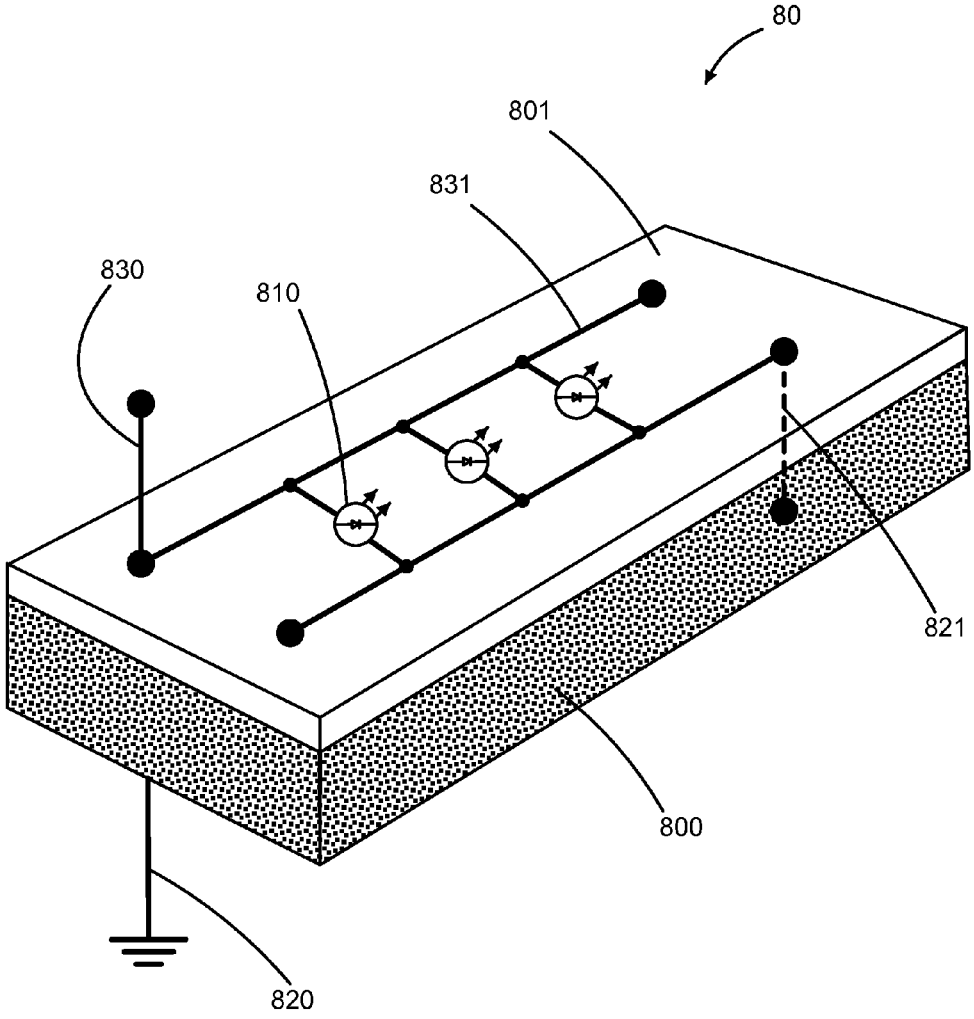
FIG. 8 illustrates an exemplary metallic substrate circuit board which may be employed in one or more present embodiments.

FIG. 8 illustrates components of a LED-based lighting apparatus that are mounted to a circuit board as comprehended by the present disclosure. The circuit board comprises a metal, metalized or metallic substrate 800. The metal substrate is preferably made of a thermally conducting metal-based material or alloy. In some embodiments, Aluminum or Aluminum alloys are used as metal substrate 800. In other embodiments, steel, iron alloys, copper, or other conducting metals or alloys thereof can be used as the metal substrate 800.

An insulating layer 801 is bonded to, adhered to, or fixed to a face of the metal substrate 800. An electrical circuit 831 is then applied to the exposed face of insulating layer 831 so as to form connections for powering the light sources (LEDs 810) of the apparatus. Typically, a power supply line 830 would be used to power the LEDs 810, and a ground connection 820 is provided to complete the circuit 831. In the illustrated embodiment, a ground connector 821 electrically couples the ground lines of circuit 831 above the insulating layer 801 to the substrate 800, which itself can serve as a ground connection for the circuit 831. However, this is not necessary in all embodiments as would be appreciated by those skilled in the art.

The entire assembly 80 would be embedded into a suitable light-permissive potting compound in some aspects as described above, the potting compound (e.g., clear or semi-clear silicone) thus providing mechanical support for the elements of assembly 80. In addition, the heat generated by LEDs 810 may be effectively removed to avoid overheating of the lighting apparatus of LEDs, by conduction of heat through metal substrate 800. The metal substrate 800 conducts heat away from the hottest regions of the apparatus and geometrically distributes and dissipates the heat towards the periphery of the circuit board into the surroundings thereof. For example, the heat is conducted towards and into the surrounding potting compound.

A circuit board having an insulating layer 801 disposed on both sides of metal substrate 800 is also possible, thereby allowing operation of a lighting apparatus with LED light sources on both faces of substrate 800 using one or two circuits 831 to power the light sources.

In some aspects, lighting sources constructed as described above are more resistant to mechanical shock and damage. The heavier metal substrate 800 is able to withstand shock forces greater than those tolerated in traditional circuit board materials. Also, when surrounded by a potting compound material, the relative densities of the metal circuit board and the surrounding potting compound favorably dissipates the mechanical forces away from the circuitry of the apparatus into the surrounding compound.

In other aspects, extensions of metal substrate 800 may be manufactured integral to the circuit board substrate 800 to increase the effectiveness of the metal substrate as a heat sink. For example, one or more sets of heat sinking "fins" or heat exchange structures having increased surface area can allow greater conductive, convective or radiative heat dissipation from the metal substrate 800.

In yet other aspects, the heat-generating elements of the apparatus may be surface mounted to the circuit board to enhance the heat conduction between the heat-generating elements and the metal substrate 800. For example, in some embodiments, enlarged pads are employed to couple the LEDs 810 to the circuit board to which they are attached. In a specific embodiment, the pad coupling an LED to the circuit board has an area greater than the area of the corresponding LED element. In another specific instance, the conducting pad may have a volume greater than the volume of its corresponding LED.

The present invention should not be considered limited to the particular embodiments described above. Various modifications, equivalent processes, as well as numerous structures to which the present invention may be applicable, will be readily apparent to those skilled in the art to which the present invention is directed upon review of the present disclosure.

The invention claimed is:

1. A portable lighting apparatus, comprising:

a solid housing;

a substantially rigid and thermally-conducting metallic circuit board having two opposing sides and having an electrically-insulating layer on at least one side thereof disposed within said housing and providing mechanical and electrical support for a plurality of LED light sources, wherein the metallic circuit board includes a metallic substrate configured to dissipate heat;

a plurality of LED light sources being electrically and mechanically coupled to said circuit board on the side of said circuit board having said electrically-insulating layer, said LED light sources being further thermally coupled to said circuit board so as to conduct heat from said LED light sources to said circuit board during operation;

an optically-permissive compound capable of transmitting at least a substantial portion of light output of said LED light sources, the compound substantially filling a space between an interior surface of said solid housing and said circuit board and LED light sources so as to provide mechanical contact with both sides of said circuit board and said LED light sources and said housing so as to conduct heat from said circuit board to said compound during operation;

a plurality of spacers associated with the circuit board to support the circuit board within an interior portion of the housing, wherein the spacers are configured to located the circuit board within the housing and absorb mechanical shock introduced into the portable lighting apparatus; and a power supply circuit for providing electrical power from a power source to a portion of said circuit board so as to energize said LED light sources.

2. The apparatus of claim 1, said metallic circuit board comprising a substrate made of any one of: aluminum, steel, or copper, or an alloy thereof.

3. The apparatus of claim 1, said compound comprising a potting compound having a viscous or semi-fluid composition at the time of manufacture of the apparatus and transformative to a composition of substantially greater viscosity after manufacture.

4. The apparatus of claim 3, said compound comprising a silicone gel substance that is substantially optically clear and that hardens from a fluid composition at the time of manufacture to a rubbery composition after manufacture.

5. The apparatus of claim 1, said compound comprising a plurality of light-scattering scatterers suspended within said compound.

6. The apparatus of claim 5, said scatterers comprising any of: fluid droplets, gas bubbles, crystalline impurities, nanoparticles, or metal particles.

7. The apparatus of claim 1, said housing having a substantially elongated shape with a first and a second end, said apparatus further comprising a first end cap proximal to said first end and a second end cap proximal to said second end, said first and second end caps mechanically arranged and designed to support or protect internal components disposed within said housing.

8. The apparatus of claim 1, said compound comprising a compound permitting a substantial portion of light to leave said apparatus from said LED light sources through said compound and through an optical window within said housing.

9. The apparatus of claim 1, said compound comprising a compound in contact with said LED light sources, said compound having a thermal conductivity greater than air so as to dissipate heat generated by said LEDs.

10. The apparatus of claim 1, said metallic circuit board comprising a metallic substrate thermally coupled to or including metallic heat sink structures to increase a surface area of said substrate so as to enhance heat dissipation from said metallic substrate.

11. The apparatus of claim 1, said metallic circuit board comprising a metallic substrate electrically coupled to a common electrical polarity.

12. The apparatus of claim 1, said LED light sources being surface mounted onto said insulating layer of said circuit board by way of a pad having a dimension greater than a dimension of said LED so as to increase a thermal conduction rate from said LED into a metallic substrate of said circuit board.

13. The apparatus of claim 1, said circuit board being substantially suspended or floated within said housing and surrounded by said compound, which substantially mechanically supports the circuit board in place once the compound is cured.

* * * * *